US010214327B1

(12) United States Patent
Bearden

(10) Patent No.: US 10,214,327 B1
(45) Date of Patent: Feb. 26, 2019

(54) HINGED LID

(71) Applicant: Paul D. Bearden, Buffalo, KS (US)

(72) Inventor: Paul D. Bearden, Buffalo, KS (US)

( * ) Notice: Subject to any disclaimer, the term of this patent is extended or adjusted under 35 U.S.C. 154(b) by 32 days.

(21) Appl. No.: 15/625,785

(22) Filed: Jun. 16, 2017

Related U.S. Application Data

(60) Provisional application No. 62/354,082, filed on Jun. 23, 2016.

(51) Int. Cl.
*B65D 43/16* (2006.01)
*B65D 51/24* (2006.01)
*B65D 43/22* (2006.01)

(52) U.S. Cl.
CPC ..... *B65D 43/161* (2013.01); *B65D 43/22* (2013.01); *B65D 51/246* (2013.01)

(58) Field of Classification Search
USPC ..... 220/810–836
See application file for complete search history.

(56) References Cited

U.S. PATENT DOCUMENTS 131,046 A 9/1872 Bailey
1,328,652 A * 1/1920 Ehlers ..... B65D 51/246 366/347
1,451,343 A 4/1923 Panagopolous
2,110,921 A 3/1938 Scurlock
2,149,698 A * 3/1939 Humphrey ..... B65D 51/246 141/112
2,483,586 A 10/1949 Limpert
2,485,303 A * 10/1949 Marcus ..... B01F 7/00333 141/112
3,312,366 A * 4/1967 Poris ..... B65D 51/246 141/381
4,469,239 A * 9/1984 Gallery, IV ..... B65D 43/161 220/826
4,483,623 A * 11/1984 Eaton ..... B01F 13/0827 366/247
5,611,098 A 3/1997 Skibik
5,695,084 A * 12/1997 Chmela ..... A47G 21/04 206/541
6,012,414 A 1/2000 Klein
6,273,288 B1 8/2001 Jarvis
6,789,683 B1 9/2004 Fisher
7,103,944 B2 * 9/2006 Johnson ..... A47J 36/06 220/315

(Continued)

*Primary Examiner* — Kareen K Thomas
(74) *Attorney, Agent, or Firm* — William R. Sharp

(57) ABSTRACT

A hinged lid, for covering a container having an open top defined by an upper rim, comprises a substantially transparent pair of sections hingedly connected to one another along an axis about which at least one of the sections may pivot between closed and open positions. The sections further have respective peripheral portions with corresponding flat lower sides, which are substantially coplanar with one another in said closed position, thereby being engageable with the rim of the container so as to accommodate various sizes thereof and protect food in the container from flies or other contamination. According to one aspect of the invention, the pivotable section can have a notch with flexible bristles associated therewith to accommodate a serving utensil while also minimizing contamination of food in the container. According to another aspect, the invention can further include a strap for removably securing the other section to the container.

9 Claims, 1 Drawing Sheet

(56) References Cited

U.S. PATENT DOCUMENTS

| | | | | |
|---|---|---|---|---|
| 8,079,488 | B2 * | 12/2011 | Darflinger | B65D 51/246<br>206/541 |
| 8,567,632 | B2 | 10/2013 | Bergeret | |
| 2001/0049001 | A1 * | 12/2001 | Mueller | B32B 7/06<br>428/138 |
| 2002/0125256 | A1 | 9/2002 | Sack | |
| 2009/0294454 | A1 * | 12/2009 | Harding | A47G 21/004<br>220/574.1 |
| 2010/0072205 | A1 * | 3/2010 | Stuart | B65D 51/247<br>220/254.3 |
| 2014/0317995 | A1 | 10/2014 | Bodo | |
| 2015/0027603 | A1 | 1/2015 | Mogol | |

* cited by examiner

HINGED LID

CROSS-REFERENCE TO RELATED APPLICATIONS

This application claims the benefit of U.S. Application 62/354,082, filed Jun. 23, 2016.

BACKGROUND OF THE INVENTION

The invention relates to a hinged lid that is particularly suitable for covering a container from which food is served in an outdoor setting (i.e. picnic).

Although a picnic can be an enjoyable activity for family and friends, containers for the food must be uncovered and recovered repeatedly as individuals serve themselves. Covers for the containers are invariably left off for long periods, during which flies and other contaminants get into the food. Moreover, when containers of various sizes have no matching lids, as is frequently the case, the use of aluminum foil or other materials, such as plastic wrap, becomes necessary. Such covering materials are rarely placed back over the containers in a manner that effectively prevents contamination of food therein.

SUMMARY OF THE INVENTION

It is, therefore, an object of the invention to provide a lid that allows a person to conveniently serve himself or herself food while minimizing contamination in an outdoor setting.

According to one aspect of the invention, the above object is realized by a hinged lid for covering a container having an open top defined by an upper rim, comprising: first and second substantially transparent sections having respective peripheral portions with corresponding flat lower sides, the sections being hingedly connected to one another so as to allow the first section to pivot between a closed position, in which the lower sides of both sections are coplanar and thereby engageable with the rim of the container, and an open position above and out of contact with the container; and a securing means, comprising at least one strap, for removably securing the second section to the container. The transparent lid sections allow a person to clearly see food in the container, consequently assisting in the decision whether or not to even open the first section of the lid to allow access to the food. This is in contrast to aluminum foil or an opaque lid, which must be removed simply to determine the contents of the container. If the food is something the individual wants to eat, he or she simply lifts the first section so that it pivots upwardly, allowing quick and easy access to the food for self-serving, followed by pivotal movement back down to the closed position so as to protect the food from contamination. In addition, closure of the lid by engagement of the flat lower sides of the peripheral portions with the rim of a container, in combination with the above-mentioned strap to removably secure the lid to the container, allows use of the invention with various sizes of containers.

According to another aspect of the invention, a hinged lid for covering a container having an upper rim and open top as described above, comprises: a pair of hingedly connected sections having respective peripheral portions with corresponding lower sides that are engageable with the rim of the container so as to close its open top, one of the sections having an outer edge and a notch extending inwardly from the outer edge so as to have a closed inner end and an open outer end adjacent to the outer edge; and a plurality of flexible bristles having respective free ends, the bristles being affixed to the closed inner end of the notch so as to extend therefrom to the free ends at the open outer end. The notch and associated bristles can accommodate the handle of a spoon or other serving utensil, while minimizing open spaces that can allow entry of insects or other contaminants.

DETAILED DESCRIPTION OF THE INVENTION

Figure 1:
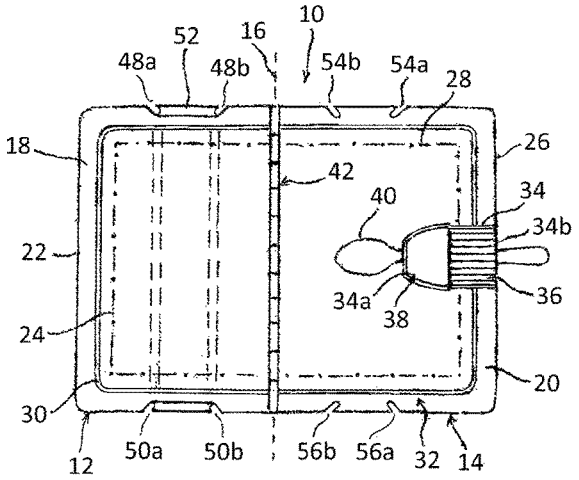
FIG. 1 is a top view of a hinged lid in accordance with one embodiment of the invention, showing its sections covering a container in which a serving utensil is received. As used herein, terms such as top, bottom, upper, lower, etc. are used with reference to the lid in its orientation when in use for the sake of convenience and clarity.

Referring to FIG. 1, this FIGURE shows the upper side of hinged lid 10, which comprises a pair of sections 12 and 14 hingedly connected to one another along a pivot axis 16 in a manner further described below. Section 14 is preferably longer than section 12 for reasons also discussed in further detail later in the application. Section 12 comprises a substantially transparent sheet of material having a peripheral portion 18, and section 14 similarly comprises a substantially transparent sheet of material having a peripheral portion 20. Peripheral portion 18 has an outer boundary 22 defined by the outer edge of section 12, and further has an inner boundary 24 as indicated by a broken line. Peripheral portion 20 has an outer boundary 26 defined by the outer edge of section 14, and further has an inner boundary 28 also indicated by a broken line. Although the inner boundaries 24 and 28 are imaginary in the illustrated embodiment since sections 12 and 14 are substantially planar, such inner boundaries of the peripheral portions could correspond to and define actual outer boundaries of respective central portions that are raised or domed (not shown), for example, to accommodate larger food items. In any event, peripheral portions 18 and 20 are preferably sufficiently wide (i.e. about two inches) to accommodate various sizes of containers, wherein such peripheral portions of corresponding closed sections are engageable with the rim 30 of a container 32 as shown. Inner boundaries 24 and 28 are also substantially continuous between the sections when the lid is closed over a container as illustrated.

In addition, section 14 has a notch 34 at the outermost end thereof. Notch 34 extends inwardly from the outer edge of section 14 so as to have a closed inner end 34*a* and an open outer end 34*b* adjacent to the outer edge. Multiple flexible bristles 36 have respective free ends and extend from a bristle base 38, affixed to section 14 in any suitable manner, to the free ends at open outer end 34*b*. The handle of a spoon or other utensil 40 can extend through notch 34 and associated bristles 36 when section 14 is closed. Bristles 36 fill notch 34 so as to surround and contact the handle of spoon 40 and thereby minimize open spaces that can allow entry of insects and other contaminants. Furthermore, bristles 36 are preferably made of silicone because of its flexibility and resistance to heat.

Continuing referral to FIG. 1, the hinged connection between sections 12 and 14 is provided in the illustrated embodiment by a continuous (i.e. "piano") hinge 42, preferably molded integrally with sections 12 and 14. Although an integrally molded continuous hinge is preferred, the hinged connection between sections 12 and 14 can be provided by any type of one or more hinges affixed to the sections by any suitable means, such as rivets. Each section is preferably comprised of a substantially transparent plastic. Preferred transparent plastics deemed by the FDA to be safe for contact with food include polycarbonate, polymethylmethacrylate (i.e. acrylic), and polyethylene terephthalate glycol (PETG). PETG is the presently preferred plastic because of a combination of desirable characteristics, including: excellent clarity; good machinability; high crack and impact resistance; dishwasher safe; and relatively low cost. When made of PETG, each of sections 12 and 14 is most preferably about 3/16 inch thick to provide a desirable rigidity and light weight.

Section 12 further has a first pair of closely adjacent slots 48*a* and 48*b*, and a second pair of closely adjacent slots 50*a* and 50*b*. The two pairs of slots are paraxially spaced from and opposite one another. As used herein, the term "paraxially spaced" means spaced along a direction substantially parallel to the above-mentioned axis 16. As shown, slots 48*a* and 48*b* extend inwardly from the outer edge of section 12 that defines outer boundary 22. Slots 50*a* and 50*b* similarly extend inwardly from the outer edge of section 12. Moreover, slots 48*a* and 48*b* have respective inner and outer ends, and slots 50*a* and 50*b* also have respective inner and outer ends. With regard to each pair of slots, the inner ends are more closely adjacent to one another than the outer ends, such that the two slots define an acute angle with respect to one another. This acute angle is preferably between about 45 and 60 degrees. The purpose of this angular orientation of each pair of slots is explained further below.

A strap 52, being preferably elastic and in the form of an endless loop, is tautly and removably received in and between the first pair of slots, 48*a* and 48*b*, and the second pair of slots 50*a* and 50*b* so as to extend under container 32 (indicated by broken lines), thereby removably securing section 12 to the container. It should be clearly evident from FIG. 1 that the angular orientation of each pair of slots assists in securing the strap in position. In a manner similar to section 12, section 14 also has a first pair of slots 54*a* and 54*b*, and a second pair of slots 56*a* and 56*b*, that are paraxially spaced from and opposite one another. A second strap (not shown) can be received in and between the two pairs of slots in section 14 to removably secure this section to container 32 when being transported. The preferred material for the strap(s) is silicone due to its elasticity and resistance to heat.

Figure 2:
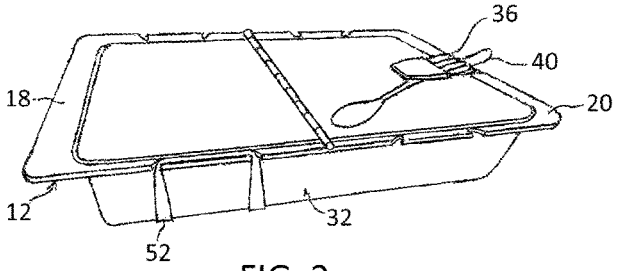
FIG. 2 is a perspective view of the hinged lid shown in FIG. 1.

Referring now to FIG. 2, this perspective view more clearly shows the manner in which the lower sides of peripheral portions 18 and 20 are flat and substantially coplanar with one another when section 14 is in its closed position, thereby engaging and contacting the rim of the container to accommodate various sizes thereof and protect food in the container from flies or other contamination. FIG. 2 also illustrates the manner in which strap 52 is snugly received under the container to removably secure section 12 thereto.

Figure 3:
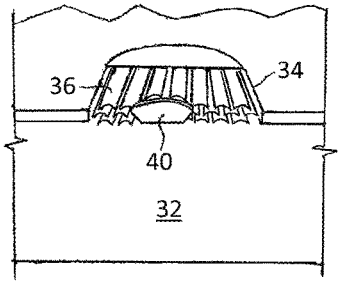
FIG. 3 is a pictorial end view of the hinged lid, most particularly showing bristles surrounding and in contact with the handle of a serving utensil extending from the container.

Referring now to FIG. 3, this end view most clearly shows how the handle of spoon 40 extends from container 32 and through notch 34 so as to be surrounded by and in contact with bristles 36. It should be apparent that notch 34 and associated bristles 36 allow use of many shapes and sizes of spoon or other utensil 40 while still preventing contamination of food within container 32.

Figure 4:
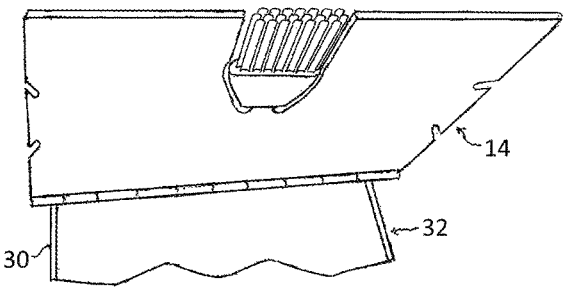
FIG. 4 illustrates the hinged lid with one of its sections pivoted upwardly to an open position.

Referring to FIG. 4, this view shows section 14 after having been lifted and pivoted upwardly to an open position above and out of contact with rim 30 of container 32, thereby allowing the user to serve himself or herself food therefrom. Although not shown, section 14 can be pivoted back further until it rests upon and in contact with the other section, section 12. Because section 14 is longer than section 12, as noted previously, an end portion of section 14 will overlap section 12 to thereby allow a user to more easily place his or her fingers under open section 14 for the purpose of moving it back to its closed position.

Thus, there is provided by the invention a hinged lid that can cover containers of various sizes in a secure manner, and which further allows a person to see through the lid and easily move a section thereof to an open position for self-service of food if he or she decides to eat the particular food item, all while minimizing contamination in an outdoor setting.

Obviously, many modifications and variations of the present invention are possible in light of the above teachings. For example, even though the illustrated embodiment shows a rectangular lid for covering a rectangular container, the lid could be in any other shape, such as round or oval to cover a bowl or crock pot. It is, therefore, to be understood that the invention can be practiced otherwise than as specifically described.

That which is claimed is:

1. A hinged lid for covering a container having an open top defined by an upper rim, comprising:

first and second substantially transparent sections having respective peripheral portions with corresponding flat lower sides, the sections being hingedly connected to one another along an axis so as to allow the first section to pivot thereabout between a closed position, in which the lower sides of both sections are coplanar and thereby engageable with the rim of the container, and an open position above and out of contact with the container, wherein the second section has an outer edge and two pairs of slots that are paraxially spaced from and opposite one another, each pair of slots including closely adjacent first and second slots respectively extending inwardly from the outer edge; and an elastic strap, in a form of an endless loop, that is removably receivable in and between the two pairs of slots to thereby removably secure the second section of the lid to the container.

2. A hinged lid as recited in claim 1 wherein each of the transparent sections is comprised of a plastic material.

3. A hinged lid as recited in claim 2 wherein the plastic material is polyethylene terephthalate glycol.

4. A hinged lid as recited in claim 1 wherein the first and second slots have respective inner and outer ends, of which the inner ends are more closely adjacent to one another than the outer ends, such that the first and second slots define an acute angle with respect to one another.

5. A hinged lid for covering a container having an open top defined by an upper rim, comprising:

a pair of hingedly connected sections having respective peripheral portions with corresponding lower sides that are engageable with the rim of the container so as to close its open top, one of the sections having an outer edge and a notch extending inwardly from the outer edge so as to have a closed inner end and an open outer end adjacent to the outer edge; and a plurality of flexible bristles having respective free ends, the bristles being affixed to the closed inner end of the notch so as to extend therefrom to the free ends at the open outer end.

6. A hinged lid as recited in claim 5 wherein the bristles are comprised of silicone.

7. A hinged lid as recited in claim 5 wherein the bristles are closely adjacent to one another.

8. A hinged lid as recited in claim 5 wherein the pair of sections are substantially transparent.

9. A hinged lid as recited in claim 5 further comprising securing means, comprising at least one strap, for removably securing the other section to the container.

* * * * *